US010337819B1

(12) United States Patent
Stark et al.

(10) Patent No.: US 10,337,819 B1
(45) Date of Patent: Jul. 2, 2019

(54) REDUCTION OF FIRST SHOT NOISE IN FIREARM SOUND SUPPRESSORS

(71) Applicants: David B. Stark, Plainfield, NH (US); Martin F. Stark, Sherborn, MA (US); Anthony J. Parilllo, Sherborn, MA (US)

(72) Inventors: David B. Stark, Plainfield, NH (US); Martin F. Stark, Sherborn, MA (US); Anthony J. Parilllo, Sherborn, MA (US)

( * ) Notice: Subject to any disclaimer, the term of this patent is extended or adjusted under 35 U.S.C. 154(b) by 0 days.

(21) Appl. No.: 16/186,830

(22) Filed: Nov. 12, 2018

Related U.S. Application Data

(63) Continuation-in-part of application No. 15/869,157, filed on Jan. 12, 2018, now Pat. No. 10,145,636.

(60) Provisional application No. 62/446,609, filed on Jan. 16, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/28; F41A 21/32; F41A 21/325; F41A 21/34; F16K 31/02
USPC ..... 89/14.1–14.5; 42/1.06; 181/223
See application file for complete search history.

(56) References Cited

U.S. PATENT DOCUMENTS

| | | | | |
|---|---|---|---|---|
| 2,010,178 | A * | 8/1935 | De Bruin | F41A 21/34 89/1.2 |
| 2,146,554 | A * | 2/1939 | Rossmann | F41A 13/12 89/14.1 |
| 3,272,074 | A * | 9/1966 | Vinson | F41A 21/34 144/144.1 |
| 3,710,679 | A * | 1/1973 | Werbell, III | F41A 21/30 89/14.4 |
| 4,392,412 | A * | 7/1983 | Schmidt | F41A 21/30 169/49 |
| 5,245,905 | A * | 9/1993 | Bundy | F41A 13/08 89/1.2 |
| 5,966,858 | A * | 10/1999 | Curtis | F41A 21/32 42/1.14 |
| 7,237,353 | B1 * | 7/2007 | Beauchamp | F41A 21/36 42/1.14 |
| 8,046,947 | B2 * | 11/2011 | Fu | F41A 21/32 114/316 |
| 2014/0262605 | A1 * | 9/2014 | Washburn, III | F41A 21/30 181/223 |
| 2015/0308772 | A1 * | 10/2015 | James | F41A 21/30 89/14.4 |

* cited by examiner

*Primary Examiner* — John Cooper
(74) *Attorney, Agent, or Firm* — Semprebon Patent Services; Jeffrey E. Semprebon

(57) ABSTRACT

First round shot noise and flash caused by combustion of oxygen contained in the air residing in a firearm sound suppresser can be reduced by providing a valve that communicates with the baffled interior space of the suppressor, and connecting a source of non-flammable gas such as $CO_2$ to the valve in order to inject the gas into the suppressor. The non-flammable gas displaces the air in the suppressor, removing the oxygen available for combustion when the first shot is fired.

12 Claims, 4 Drawing Sheets

REDUCTION OF FIRST SHOT NOISE IN FIREARM SOUND SUPPRESSORS

FIELD OF THE INVENTION

The present invention relates to firearm suppressors employed to reduce the sound signature of gunshots.

BACKGROUND

Sound suppressors are mounted onto firearms to control the expansion of muzzle gases to reduce the sound intensity of the shots fired. The reduction in sound can aid in reducing hearing damage to the shooter and reduce noise to avoid disturbance to others in the vicinity of the shooter. The suppressor may also reduce muzzle flash, and thus aid in concealing the location of the shooter. The sound suppressor secures onto the barrel of the firearm, typically via a threaded connection, and encloses a baffled interior space into which the muzzle gases expand. The baffled interior is configured to control expansion of the muzzle gases to reduce the resulting sound intensity.

It has been found that the first shot fired through a sound suppressor frequently is louder than following shots, due to the hot muzzle gases burning in the oxygen contained in the residual air in the baffled interior space. This is frequently referred to as "first round pop" or FRP. To avoid this additional noise, users may attempt to inject a non-flammable gas such as carbon dioxide ($CO_2$) from a source of compressed gas into the suppressor to displace the residual air. Since this operation is typically conducted while a live round is chambered, it requires the user to place their hands in proximity to the exit of the suppressor, in line with the muzzle, to inject the gas; this creates an inherently unsafe condition, as well as being inconvenient.

SUMMARY

The present invention provides an apparatus and method that allow the user of a suppressed firearm to safely and conveniently inject a non-flammable gas into a baffled interior space of the suppressor to displace residual air and reduce "first round pop" (FRP). The invention can be incorporated into a suppressor, or can employ a suppressor mounting device to allow the use of a pre-existing suppressor; in this latter case, the mounting device typically mounts to the barrel of the firearm, and the suppressor is mounted onto the mounting device so as to be aligned with and in communication with the firearm barrel. Alternatively, the gas could be supplied to the suppressor via the barrel of the firearm. In all cases, a valve is provided that connects between a source of compressed gas and the baffled interior space of the suppressor. The valve can be selectively actuated by the user to introduce the non-flammable gas, causing this gas to displace residual air in the interior of the suppressor. With the interior filled with non-flammable gas, the combustion of residual oxygen caused by the first shot is avoided. Various non-flammable and/or inert gases can be employed, such as carbon dioxide, nitrogen, argon, etc.; carbon dioxide ($CO_2$) is frequently preferred due to its low cost.

The source of the compressed non-flammable gas can be either an independent gas source or a dedicated source; in the latter case, the gas source is typically mounted onto either the firearm or the suppressor.

In the case where an independent gas source is employed, the valve may be configured so as to be activated when the gas source is brought into contact with the valve. In such cases, the valve may have a valve first end and a valve second end, where the valve first end is configured to receive and seal against the gas source, and the valve second end communicates with the baffled interior space of the suppressor. The valve acts to allow passage of gas from the valve first end into the baffled interior space via the valve second end when a source of compressed gas is connected to the valve first end, and acts to block passage of gases therethrough when no source of compressed gas is connected to the valve first end. Thus, when a compressed gas source is connected to the valve first end, the valve is opened to allow the compressed gas through the valve into the baffled interior space of the suppressor to displace residual air. When the compressed gas source is disconnected from the valve first end, the valve is closed so as to prevent escape of muzzle gases through the valve when the firearm is discharged.

One preferred type of valve that can be employed is a Schrader valve, allowing the use of commercially available sources of compressed $CO_2$ to be connected to the valve first end. One such gas source is a commercially-available handheld unit intended for inflating bicycle tires, the device having a body that accepts a conventional canister of compressed $CO_2$ and a head that connects to a Schrader valve and has a manually operated device valve that allows the user to manually open the device valve to allow the compressed $CO_2$ into the Schrader valve, and subsequently close the device valve to contain the remaining compressed $CO_2$. The valve employed in the present invention may be permanently attached, such as by welding, brazing, or similar techniques, or may be replaceably attached such as by threads to allow it to be replaced if worn. In some cases, it may be advisable to replace the valve after a certain number of shots have been fired; many suppressors have internal baffle components that require periodic replacement, and the valve can be designed to be replaced when the internal components are.

As noted above, a dedicated gas source mounted onto the firearm or suppressor can be employed. In such cases, the compressed gas source is typically a pressurized canister mounted to the firearm or suppressor, and communicates with the baffled interior space of the suppressor via a manually-activated valve and associated gas supply line. The configuration of the valve and gas supply line can be selected to suit the location where the gas canister is mounted and the desired position for activating the valve, and the valve may be controlled by direct manipulation or may have a remote control, such as an electrically-activated valve operated by a remote switch positioned for the convenience of the user; hereafter, the combination of the valve and related elements are collectively referred to as the valve, regardless of the exact configuration employed. The use of a dedicated gas source may be particularly advantageous for long guns, where the length of the barrel results in the suppressor being positioned too far forward to be conveniently reached by the user while holding the firearm. It may be advantageous to place the valve in the immediate proximity of the suppressor or mounting device, to reduce the exposure of components to hot propellent gases; in such cases, remote activation of the valve may be particularly convenient.

The valve and related elements may be mounted to the firearm by conventional mounting means, such as by clamping components onto accessory rails provided on the firearm, or may be incorporated into one or more replacement firearm components, such as a replacement stock and/or forearm. The activation of the valve can be momentary, such that the valve is closed except when actively opened by the action of the user, or can be set to deliver a prescribed amount of gas responsive to an action by the user.

Regardless of whether an independent or dedicated gas source is employed, the valve can be incorporated into the suppressor. The valve is mounted to a suppressor body so as to communicate with the baffled interior space of the suppressor. Suppressors typically have a suppressor first end, provided with female threads or other mounting structure to securely attach to a corresponding thread or other mounting structure on a barrel of the firearm, and a suppressor second end having a suppressor exit through which a fired bullet passes and through which muzzle gases may escape after being slowed and cooled by their passage through the baffled interior space. It is generally preferred for the valve to be positioned near the suppressor first end, communicating with the initial blast chamber, the section of the interior space into which the propellent gases first expand upon entering the suppressor. This positioning enables the injected non-flammable gas to push the residual air in the baffled interior space toward the suppressor exit. At the time when the non-flammable gas is injected, the firearm typically has a round of ammunition chambered, closing the breach end of the barrel, and thus the only path for escape of gases is through the suppressor exit. When a separate gas source is employed, positioning the valve near the suppressor first end also serves to distance the hands of the user from the suppressor exit for increased safety when bringing the gas source into engagement with the valve.

When a pre-existing suppressor is to be employed, the valve can be provided in an intermediate mounting device attached between the suppressor and the firearm barrel. In this case, the mounting device typically has a mount body having a mount first end and a mount second end, where the mount first end has a first end mounting structure configured to removably secure onto the barrel mounting structure provided on the firearm barrel, and the mount second end has a second end mounting structure that is configured to allow the suppressor mounting structure to securely attach thereto. Typically, the barrel mounting structure is provided by male threads, and the first end mounting structure is provided by corresponding female threads. Similarly, the suppressor mounting structure is typically provided by female threads, and the second end mounting structure is provided by corresponding male threads. It should be appreciated that the threads on the mount first end may not correspond to the threads on the mount second end, allowing the mounting device to serve as a thread adapter to allow mounting the suppressor to a firearm having a different thread pattern than the one for which the suppressor is designed. It should also be appreciated that the mounting device could be a multi-piece structure, such as a two-part suppressor mount intended to facilitate rapid attachment and detachment of the suppressor with less effort than required to screw and unscrew the threads.

The mount body encloses a mount interior space, which is configured to allow the passage of a bullet therethough without obstruction and which communicates with the baffled interior space of the sound suppressor when the suppressor mounting structure is secured onto the second end mounting structure. The valve is attached to the mount body such that the valve communicates with the mount interior space, which in turn communicates with the baffled interior space of the suppressor. Thus, when the valve is activated, the non-flammable gas is delivered from the source through the valve into the mount interior space and from there into the baffled interior space of the suppressor, displacing the residual air.

An alternative approach, which requires modification of the firearm, is to supply the gas to the firearm barrel, either directly or via a gas tube such as employed in some semi-automatic and fully-automatic firearms, such as the AR-10/AR-15 family of rifles. In such cases, the valve communicates with the baffled interior space of the suppressor via the barrel, onto which the suppressor is mounted.

BRIEF DESCRIPTION OF FIGURES

FIG. 1 illustrates the suppressor prior to mounting onto the firearm barrel, while FIG. 2 illustrates the sound suppressor when secured onto the barrel of a firearm by a threaded connection. The valve is a Schrader-type valve, which is designed to open when a corresponding gas supply device is engaged against the valve.

DETAILED DESCRIPTION

Figures 1, 2:
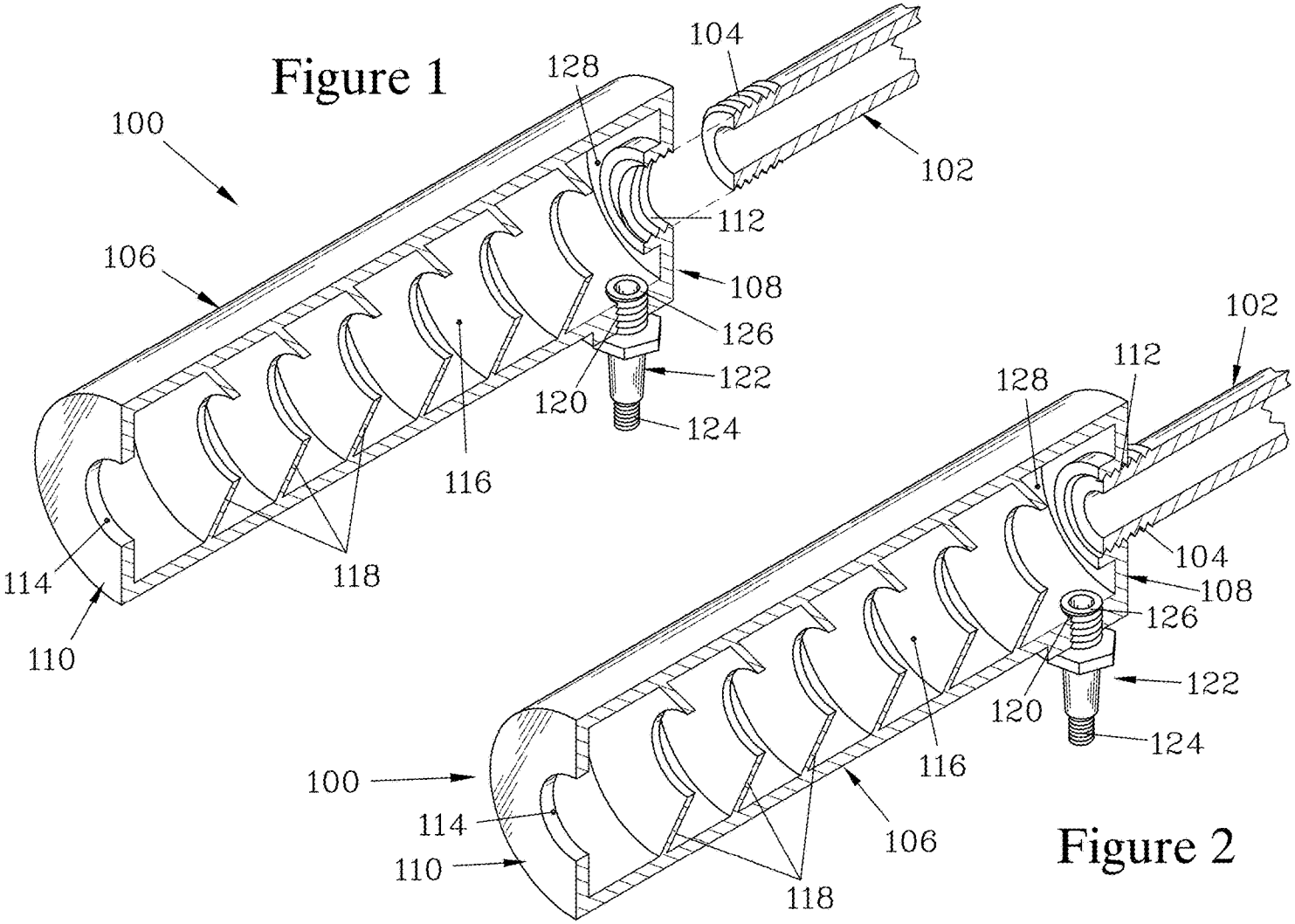
FIGS. 1 and 2 are sectioned isometric views that illustrate a sound suppressor that forms one embodiment of the present invention, which is designed for use with a pre-existing source of non-flammable gas such as a $CO_2$ inflator commonly employed for inflating bicycle tires. The suppressor has a suppressor body that encloses a baffled interior space, and a valve mounted to the suppressor body allows a user to inject gas into the baffled interior space to displace residual air.

FIGS. 1 and 2 illustrate a sound suppressor 100 for attachment to a firearm barrel 102, and which incorporates one embodiment of the present invention. FIG. 1 illustrates the suppressor 100 prior to installation onto a barrel mounting structure 104 provided on the firearm barrel 102, while FIG. 2 illustrates the suppressor 100 after installation. In this embodiment, the barrel mounting structure 104 is provided by a male thread.

The suppressor 100 has a suppressor body 106 having a suppressor first end 108 and a suppressor second end 110. The suppressor first end 108 is provided with a suppressor mounting structure 112 that is configured to securely, removably mount onto the barrel mounting structure 104. In the embodiment illustrated, the suppressor mounting structure 112 is provided by a female thread that matches the male thread that provides the barrel mounting structure 104, allowing the suppressor first end 108 to be screwed onto the barrel mounting structure 104, as shown in FIG. 2. The suppressor second end 110 is provided with a suppressor exit 114 to allow passage of a bullet out of the suppressor 100.

The suppressor body 106 encloses a baffled interior space 116, which contains a series of baffles 118 that serve to control the expansion of muzzle gases from the firearm barrel 102 while allowing passage of a bullet through the baffled interior space 116. It should be appreciated that the details of the baffles 118 are not a part of the present invention, and the use of any interior structure designed to reduce the sound of escaping muzzle gases could be employed.

The suppressor body 106 has a body threaded passage 120, into which a valve 122 is screwed. The valve 122 can be readily replaced if worn or damaged. The valve 122 illustrated is a Schrader valve, and has a valve first end 124 that is configured to connect to a conventional source of compressed gas. One convenient source of gas is a commercially available device used for inflating bicycle tires, having a body that connects onto a conventional canister of compressed $CO_2$ and a head with a manually-operated device valve that can be opened against to release the compressed $CO_2$ from the canister into the Schrader valve. For convenient use, it is preferred to use a push-on inflation device that does not require being threaded onto the Schrader valve; two examples of such push-on inflation devices are the Full Metal Jacket and Air Chuck models offered by Genuine Innovations of San Luis Obispo, Calif.

The valve 122 has a valve second end 126 that communicates with the baffled interior space 116. The valve 122 acts to allow passage of gas from the valve first end 124 through the valve second end 126 into the baffled interior space 116 when a source of compressed gas is connected to the valve first end 124, and acts to block passage of gases through the valve 122 when no source of compressed gas is connected to the valve first end 124, thereby acting to prevent escape of hot propellant gases through the valve 122 when the firearm is discharged.

The valve 122 is positioned near the suppressor first end 108, and communicates with an initial blast chamber 128 of the interior space 116; the initial blast chamber 128 is the first portion of the baffled interior space 116 into which the propellent gases expand when the firearm is discharged. The position of the valve 122 allows the user to readily apply the compressed gas source while keeping their hands clear of the suppressor exit 114, and allows the injected $CO_2$ to push air residing in the baffled interior space 116 toward the suppressor exit 114 to facilitate removal of the oxygen-containing air from the baffled interior space 116. Since the firearm barrel 102 is typically closed at its breach end by a chambered round of ammunition when the $CO_2$ is injected, the suppressor exit 114 is the only path for escape of gases.

Figure 3:
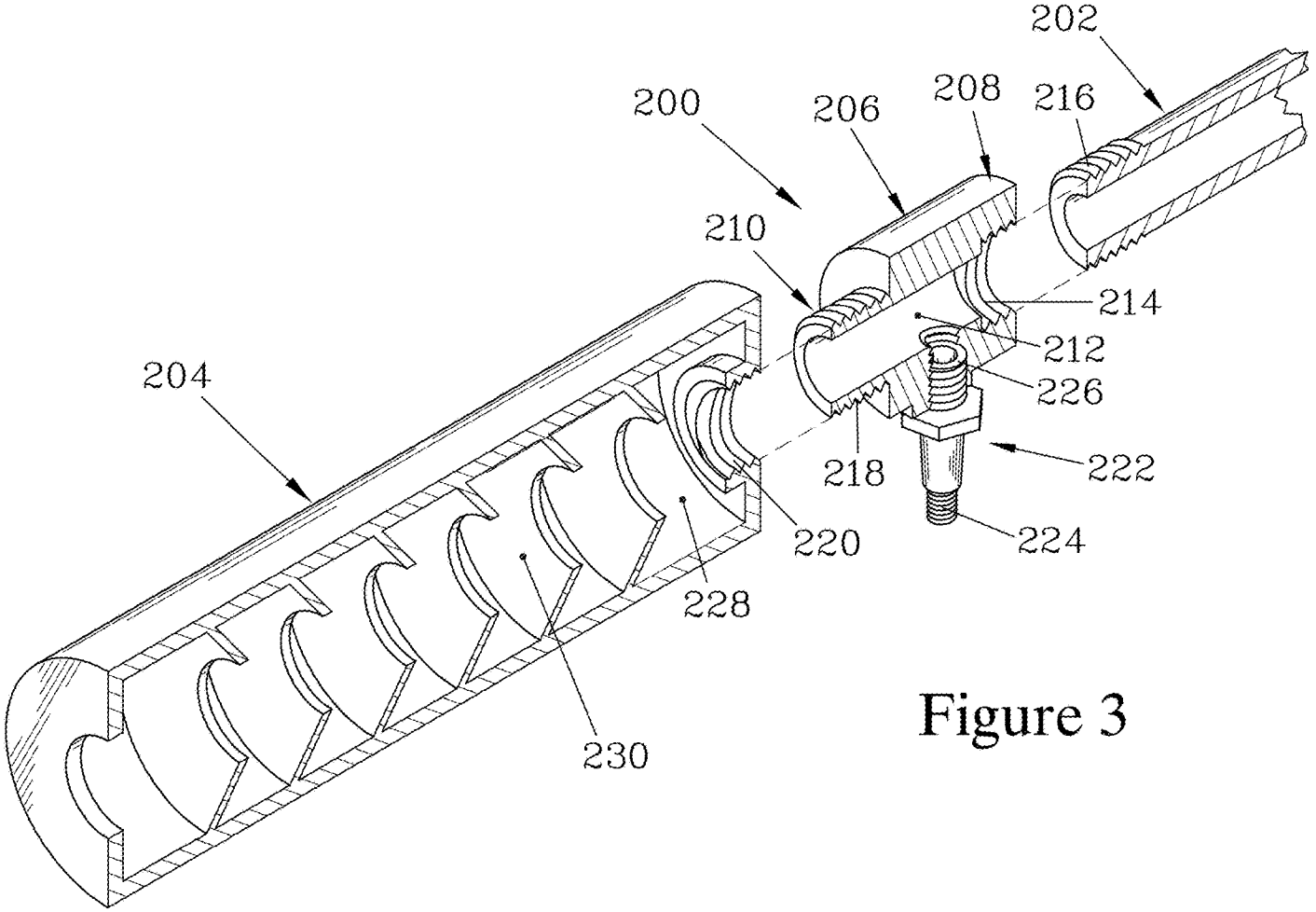
FIG. 3 is a sectioned isometric view that illustrates a suppressor mounting device that forms another embodiment of the present invention, which allows the use of a pre-existing suppressor. The mounting device has a mount body into which a valve communicates, and can be secured between the firearm barrel and the suppressor.

While the present invention can be incorporated directly into a sound suppressor, as shown in FIGS. 1 and 2, some users may wish to obtain the benefit of the present invention while employing a pre-existing suppressor. FIG. 3 illustrates a suppressor mounting device 200 that is designed to be interposed between a firearm barrel 202 and a pre-existing suppressor 204.

The mounting device 200 has a mount body 206 having a mount first end 208 and a mount second end 210, and encloses a mount interior space 212. The mount first end 208 has a first end mounting structure 214 configured to removably secure onto a barrel mounting structure 216 provided on the firearm barrel 202; as illustrated, these mounting structures (214, 216) are provided by matching threads. The mount second end 210 is provided with a second end mounting structure 218 that is configured to attach to a suppressor mounting structure 220 of the suppressor 204; again, these mounting structures (218, 220) are typically provided by matching threads.

The mounting device 200 is provided with a valve 222, which again can be provided by a Schrader valve having a valve first end 224 designed to connect to conventional $CO_2$ bicycle tire inflators or similar devices. The valve 222 also has a valve second end 226, which communicates with the mount interior space 212. The mount interior space 212 is configured to leave a clear path therethrough to avoid obstructing the passage of a bullet from the firearm barrel 202 into the suppressor 204. When the suppressor 204 is mounted to the second end mounting structure 218, the mount interior space 212 communicates with an initial blast chamber 228 of a baffled interior space 230 of the suppressor 204, and thus the valve second end 226 communicates with the baffled interior space 230 via the mount interior space 212. When a $CO_2$ bicycle tire inflator or other source of compressed gas is connected to the valve first end 224, the compressed non-flammable gas can flow through the valve 222 into the mount interior space 212 via the valve second end 226, and thereafter can pass into the baffled interior space 230 to displace oxygen-containing air residing in the suppressor 204.

While the suppressor mounting device 200 illustrated is a single-piece device, the present invention can be incorporated into multi-part suppressor mounting devices, such as the Gemtech QDA suppressor mounting device offered by Gemini Technologies, Inc. of Eagle, Id. The Gemtech QDA adapter is intended to allow a user to readily switch a single suppressor between multiple firearms, and has a base portion, which threads onto a firearm barrel, and a suppressor portion, onto which the suppressor threads. The two portions are connected together by a quick-detaching bayonet-type locking structure. When a mounting device of the present invention employs such a structure, the valve could be provided in either of the portions, but is preferably provided on the suppressor portion to simplify the structure of the base portion, as the user may want multiple base portions to equip a number of firearms.

While the embodiments discussed above employ a separate gas source such as a bicycle tire inflator that is manually brought into contact with the valve to inject the non-flammable gas, in some cases it may be preferred to employ a dedicated gas source that remains attached to the firearm. This may be particularly true for rifles, where the length of the barrel makes it unwieldy for the user to position a compressed gas source into contact with a valve located near the muzzle. This could be overcome by connecting the valve to the suppressor or suppressor mount by a tube, allowing the tire inflator to be more conveniently located, but this approach may result in a less finished appearance for the resulting structure.

Figure 4:
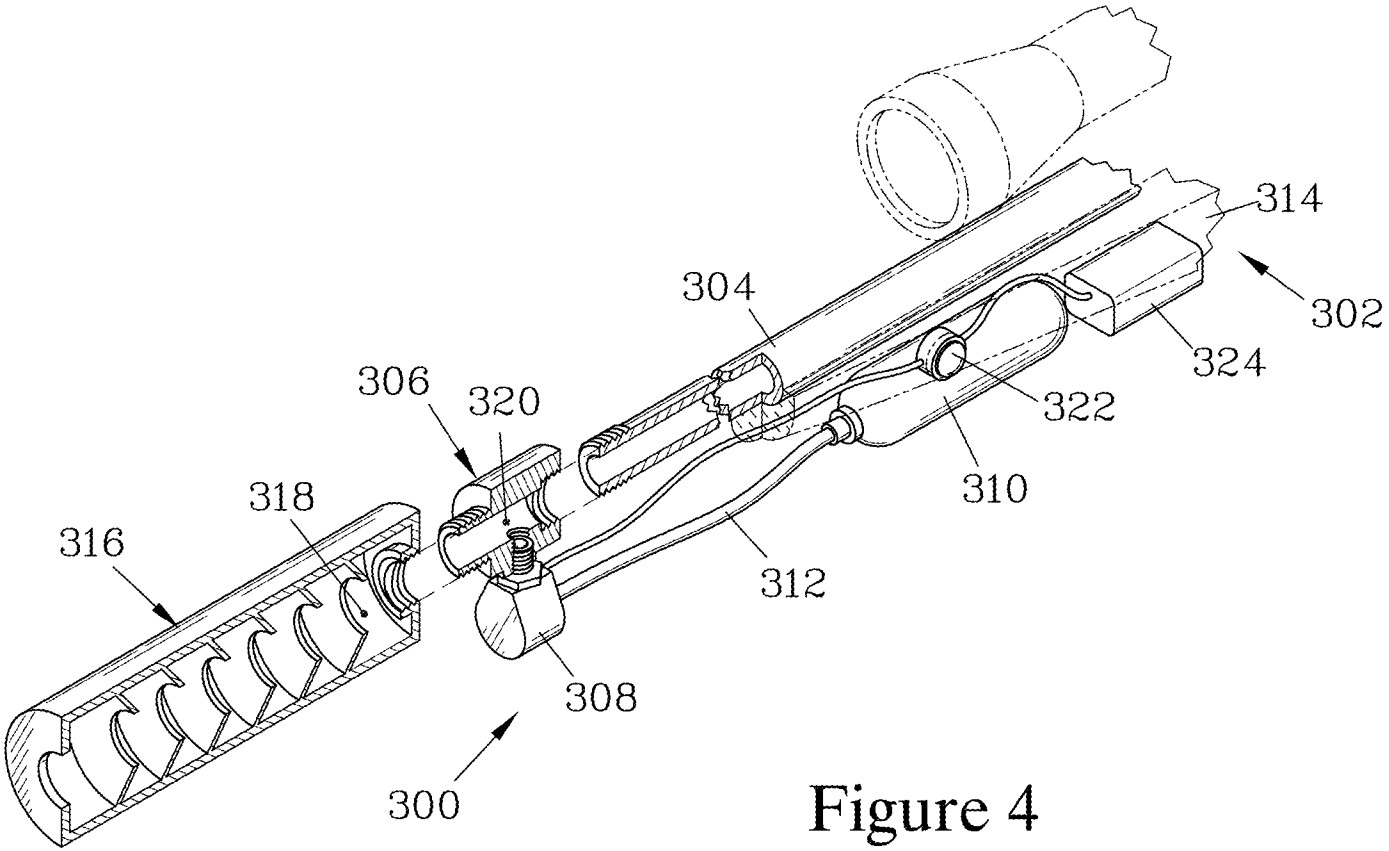
FIG. 4 is a sectioned isometric view that illustrates another suppressor mounting device for attaching a pre-existing suppressor onto a firearm barrel. However, the mounting device of this embodiment is designed for use with a dedicated gas source, which is a compressed gas canister mounted to the firearm. The mounting device has a mount body and a valve, where the valve is an electrically-operated valve controlled by a switch positioned on the firearm in a location convenient for the user.

FIG. 4 illustrates a noise reducing system 300 that remains attached to a firearm 302 having a barrel 304. The system 300 includes a suppressor mounting device 306 that attaches to the barrel 304 (and could be permanently affixed thereto), a valve 308, and a compressed gas source 310 which is connected to the valve 308 by a gas supply line 312. The compressed gas source 310 is a canister of non-flammable gas such as $CO_2$, and in this embodiment is at least partially housed in a forearm 314 (shown in phantom) of the firearm 302.

The mounting device 306 illustrated is functionally similar to the mounting device 200 discussed above; the mounting device 306 attaches onto the barrel 304 and in turn provides a mounting to attach a sound suppressor 316 having an interior baffled space 318. When the suppressor 316 is mounted, the baffled interior space 318 communicates with a mount interior space 320 of the mounting device 306. The valve 308 communicates with the mount interior space 320.

The valve 308 of this embodiment is an electrically-operated valve, which can be opened by the user by pressing a switch 322 that is positioned on the forearm 314 where it can be conveniently reached by the user while holding the firearm 302. A battery 324 serves to power the valve 308, and the switch 322 can be a momentary-on switch that remains closed, opening the valve 308 to release gas into the mount interior space 320, only as long as it is manually depressed by the user. While an electrically-operated valve is illustrated, alternative types of valves and controls could be employed. The valve can open with a momentary response, where it remains open so long as pressure is applied by the user, or could be metered or electronically controlled to open for a prescribed time in response to a single activation by the user, to deliver a specified amount of gas sufficient to displace the residual air in the baffled interior space 318. The use of compressed gas cylinders and control valves is well known in the art of airguns employed to shoot paintballs, and similar techniques can be readily adapted for the present invention.

Figure 5:
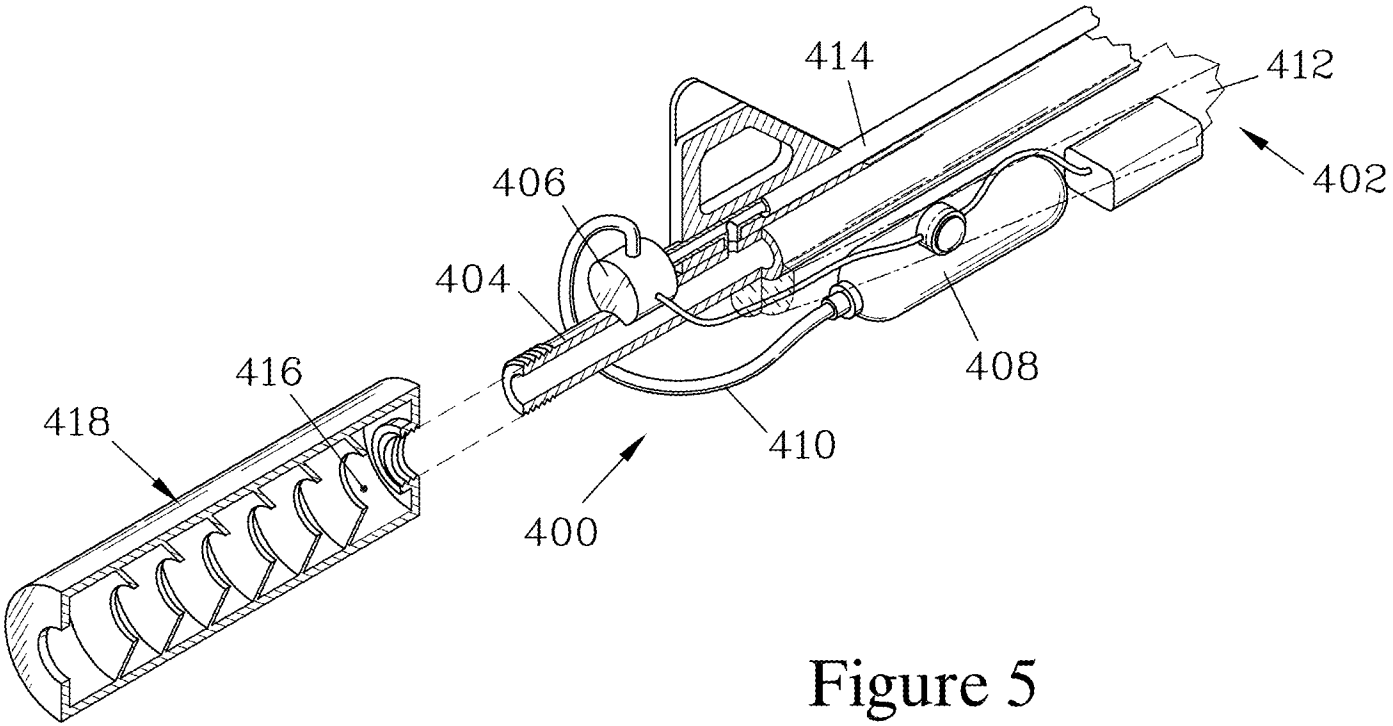
FIG. 5 is a sectioned isometric view that illustrates a noise suppression apparatus that again employs a dedicated gas source and valve; however, in this apparatus, the valve supplies the gas to the suppressor via a gas tube that communicates with the suppressor via the barrel of the firearm.

FIG. 5 illustrates a noise reducing system 400 that again remains attached to a firearm 402 having a barrel 404; the system 400 having a valve 406 and a compressed gas source 408 that is connected to the valve 408 by a gas supply line 410. The compressed gas source 408 is a canister of non-flammable gas such as $CO_2$, and may again be at least partially housed in a forearm 412 (shown in phantom) of the firearm 402. The firearm 402 is a gas-action semi- or fully-automatic firearm that has a gas tube 414 that directs a portion of the combustion gases from the barrel 404 to work the action. In the system 400, the valve 406 is connected to the gas tube 414, such that activating the valve 406 releases non-flammable gas from the gas source 408 into gas tube 414. The rear end (not shown) of the gas tube 414 is closed off by an element of the action (typically a portion of the bolt assembly), so the gas flows from the gas tube 414 into the barrel 404. Since the rear end of the barrel is closed off by a chambered round of ammunition, the gas then flows into a baffled interior space 416 of a suppressor 418 attached to the barrel 404. Thus, in this embodiment, the valve 406 communicates with the baffled interior space 416 via the gas tube 414 and the barrel 404. While FIG. 5 illustrates a system employing a dedicated source of non-flammable gas, it should be appreciated that a valve for engaging a pre-existing source of gas (such as discussed above with regard to FIGS. 1-3) could be employed to direct the gas into the gas tube when the valve is activated, providing an alternate scheme for introducing the gas from the valve into the suppressor.

Preliminary testing of a device of the present invention similar to that shown in FIG. 3 resulted in a noticeably reduced sound using a Warlock suppressor on a Walther MP22 pistol, using Gemtech .22LR ammunition. The test was conducted using calibrated Bruel & Kjar 2209 sound meters, using MilStd 1474D, and performed Bill Arevelo of NFAtalk.org. In each series of shots, the suppressor was first purged with air to provide an initial condition with residual oxygen in the suppressor. A series of ten shots made without injecting $CO_2$ had sound level readings from 121-125.5 dB, with a mean reading of 122.8 dB. In comparison, using the device to inject $CO_2$ into the suppressor resulted in a series of ten shots having sound level readings from 114-117 dB, with a mean reading of 115.5 dB, for a mean reduction of 7.3 dB using the device to inject $CO_2$.

Another test was conducted employing a Silencerco Harvester model suppressor on a Ruger Precision Rifle, rechambered for 0.260 Remington, again using a device similar to that shown in FIG. 3; this testing was conducted by Marc Trossbach, a former US Special Forces Sniper, using a MagnetoSpeed V3 chronograph. While initially intended to evaluate the sound reduction provided by the device, the testing showed improvements in both higher muzzle velocity and more consistent velocities. A first series of tests compared muzzle velocity for reloaded ammunition using 130 gr. bullets. Without injecting $CO_2$, the average muzzle velocity (MV) was 2946 feet per second (fps), with a standard deviation of 11 fps for six shots. Using the device to inject $CO_2$ for 1 second before each shot, a second series resulted in an average MV of 2975 fps (+29 FPS) and a standard deviation of only 3 fps (−8 fps). A similar comparison using Hornady 130 gr. match ammunition resulted in an average MV of 2738 fps and standard deviation of 18 fps for five shots, while injecting $CO_2$ using the device resulted in an average MV of 2859 fps (+121 fps) and a standard deviation of 3 fps (−15 fps). It is believed that purging the suppressor to prevent combustion of gases beyond the muzzle may act to reduce turbulence in the suppressor, thus increasing consistency and raising the muzzle velocity. Informal testing using the same rifle and suppressor, but with supersonic ammunition, again showed improved consistency with the injection of $CO_2$ using a device of the present invention. Additionally, cooling the barrel with periodic injections of $CO_2$ was found to improve the ability to sight the rifle, due to reduced mirage effect of ripples in the air above the barrel caused by heating. For this testing, an extension tube was employed to position the pre-existing gas inflator at a more convenient location for the user to allow injecting the $CO_2$ while maintaining a consistent shooting posture.

While the novel features of the present invention have been described in terms of particular embodiments and preferred applications, it should be appreciated by one skilled in the art that substitution of materials and modification of details can be made without departing from the spirit of the invention.

The invention claimed is:

1. An apparatus for allowing a user to inject a non-flammable gas into a baffled interior space of a sound suppressor mounted to a barrel of a firearm, the apparatus comprising:

a dedicated source of compressed non-flammable gas mounted with respect to the firearm; and a selectively activatable valve communicating with the baffled interior space and connected to said source of compressed non-flammable gas, said valve being closed by default, and being openable by an action of the user, and when opened allowing the non-flammable gas to flow through said valve into the baffled interior space to displace air in the baffled interior space with the non-flammable gas, which acts to remove oxygen available for combustion inside the baffled interior space.

2. The apparatus of claim 1 wherein said valve communicates directly with the suppressor.

3. The apparatus of claim 2 wherein said valve releases the gas into an initial blast chamber of the baffled interior when said valve is open.

4. The apparatus of claim 1 wherein said valve communicates with the suppressor via a suppressor mounting device that attaches between the suppressor and the barrel.

5. The apparatus of claim 1 wherein said valve communicates with the suppressor via the barrel of the firearm.

6. The apparatus of claim 1 further comprising:

a switch that controls the valve to allow the user to selectively open said valve by operating said switch.

7. A method for injecting a non-flammable gas into a baffled interior space of a sound suppressor mounted to a barrel of a firearm, the method comprising the steps of:

providing a dedicated source of compressed non-flammable gas;

providing a selectively activatable valve that is connected to the source of compressed non-flammable gas and communicates with the baffled interior space; and selectively opening the valve to allow the non-flammable gas to flow through the valve into the baffled interior space to displace air in the baffled interior space with the non-flammable gas, which acts to remove oxygen available for combustion inside the baffled interior space.

8. The method of claim 7 wherein the valve communicates directly with the suppressor.

9. The method of claim 8 wherein the valve releases the gas into an initial blast chamber of the baffled interior when the valve is open.

10. The method of claim 7 further comprising the step of:

inserting a suppressor mounting device having a mount interior space between the firearm barrel and the suppressor such that the mount interior space communicates with the baffled interior space of the suppressor, the valve being mounted to the suppressor mounting device so as to communicate with the baffled interior space via the mount interior space.

11. The method of claim 7 wherein the valve communicates with the suppressor via the barrel of the firearm.

12. The method of claim 7 wherein said step of selectively opening the valve further comprises the steps of:

providing a switch that opens the valve when activated; and selectively operating the switch.

* * * * *